US010017719B2

(12) United States Patent
Glasbey et al.

(10) Patent No.: US 10,017,719 B2
(45) Date of Patent: Jul. 10, 2018

(54) DETERGENT FOR MEDICAL INSTRUMENTATION

(71) Applicant: Whiteley Corporation Pty. Ltd., North Sydney, New South Wales (AU)

(72) Inventors: Trevor Owen Glasbey, Tanilba Bay (AU); Nicolas Alan Roberts, Woodrising (AU); Christopher David Hoffman, Raymond Terrace (AU); Phillip John Morgan, Mona Vale (AU)

(73) Assignee: Whiteley Corporation PTY. LTD. (AU)

( * ) Notice: Subject to any disclaimer, the term of this patent is extended or adjusted under 35 U.S.C. 154(b) by 0 days.

(21) Appl. No.: 15/540,786

(22) PCT Filed: Jan. 21, 2016

(86) PCT No.: PCT/AU2016/050029
§ 371 (c)(1),
(2) Date: Jun. 29, 2017

(87) PCT Pub. No.: WO2016/127206
PCT Pub. Date: Aug. 18, 2016

(65) Prior Publication Data

US 2017/0369820 A1 Dec. 28, 2017

(30) Foreign Application Priority Data

Feb. 12, 2015 (AU) ..... 2015900443

(51) Int. Cl.

| | |
|---|---|
| ***C11D 3/386*** | (2006.01) |
| ***C11D 7/08*** | (2006.01) |
| ***C11D 7/26*** | (2006.01) |
| ***C11D 7/32*** | (2006.01) |

(52) U.S. Cl.
CPC ..... *C11D 3/386* (2013.01); *C11D 7/08* (2013.01); *C11D 7/265* (2013.01); *C11D 7/3218* (2013.01)

(58) Field of Classification Search
CPC ..... C11D 11/0023; C11D 11/0041; C11D 3/38609; C11D 7/10
USPC ..... 510/161, 393, 401
See application file for complete search history.

(56) References Cited

U.S. PATENT DOCUMENTS

| | | | | |
|---|---|---|---|---|
| 4,261,868 | A | 4/1981 | Hora et al. | |
| 5,489,531 | A | 2/1996 | Benson | |
| 5,810,944 | A | 9/1998 | Smitkowski et al. | |
| 6,562,296 | B1 | 5/2003 | Tiarks et al. | |
| 2009/0104073 | A1* | 4/2009 | Kaiser | A01N 63/02 422/28 |
| 2009/0149363 | A1* | 6/2009 | Smith | C11D 3/046 510/161 |
| 2010/0009884 | A1 | 1/2010 | Kritzler et al. | |
| 2010/0190676 | A1 | 7/2010 | Smith et al. | |
| 2013/0296213 | A1 | 11/2013 | Isobe et al. | |
| 2015/0322383 | A1* | 11/2015 | Ortmann | C11D 3/10 435/264 |

FOREIGN PATENT DOCUMENTS

| | | | |
|---|---|---|---|
| CN | 103087841 | A | 5/2013 |
| EP | 0481663 | A1 | 4/1992 |
| EP | 1327674 | B1 | 6/2008 |
| GB | 2360041 | A | 9/2001 |
| GB | 2482164 | A | 1/2012 |
| WO | 2011052501 | A1 | 5/2011 |

OTHER PUBLICATIONS

Official Action in Japanese Patent Application No. 2017-542140 (dated Jan. 30, 2018).
Extended European Search Report in EP Patent Application No. 16748476.5 (dated Mar. 28, 2018).
Official Action in Republic of Korea Patent Application No. 10-2017-7025541 (dated Dec. 28, 2017).

* cited by examiner

*Primary Examiner* — Gregory Webb
(74) *Attorney, Agent, or Firm* — Andrew S. Langsam; Pryor Cashman LLP

(57) ABSTRACT

A cleaning composition comprising:
a. At least one alkanolamine
b. At least one mineral acid
c. At least one salt of a hydroxycarboxylic acid
d. At least one protease enzyme;
wherein said composition contains no surfactant.

30 Claims, No Drawings

DETERGENT FOR MEDICAL INSTRUMENTATION

FIELD OF THE INVENTION

The invention relates to a cleaning composition which produces low or no foam in use, intended for automated cleaning of medical, surgical and other instrumentation.

BACKGROUND OF THE INVENTION

In order to successfully reprocess used medical instruments such as forceps, retractors, scissors, speculums, rigid endoscopes, flexible endoscopes etc., it is desirable to remove all biological soil such as blood, fat, tissue fragments etc. from the instrument prior to sterilisation or disinfection. Any residual soil left on the device may be very likely to compromise the sterilisation or disinfection processes, thus placing the next patient exposed to the soiled instruments liable to acquire a nosocomial infection.

Typically most medical instrumentation is reprocessed automatically in washer disinfectors. In the case of most surgical instrumentation, the washer disinfectors used are typically provided with a plurality of spray arms. The instruments are loaded into trays and placed into the washer-disinfector for cleaning.

Water is then introduced into the chamber and pumped through the spray arms at a relatively high pressure to provide a pre-wash. The chamber is drained, and additional water added, and heated to between 50° C. and 60° C. Once heated, a small quantity of detergent is pumped into the chamber, and the resultant solution again pumped at relatively high pressure through the spray arms. Because of the extreme agitation caused by the spray arm, it is necessary to use a detergent with little or no tendency to foam, even when contaminated with protein. Any significant foaming produced during the wash cycle may adversely affect the cleaning efficacy, particularly in and around any joints or hinges present on the instrument as the foam may prevent access to the underlying soil. This effect may be even more pronounced in a lumened device.

Whilst many low foam surfactants are known, and have been successfully used in the automated cleaning of medical instruments, many pose certain challenges.

Firstly, whilst the formulation may be low foaming, the foam may be persistent in a dynamic environment such as found in a washer disinfector, particularly in the newer models which utilise higher pressure pumps to improve cleaning efficacy.

Secondly, the most common means to control foam is the use of non-ionic surfactants, particularly alkyl alkoxylates, by manipulation of the solution cloud point. As is known in the art, heating a solution of a non-ionic surfactant above its cloud point typically destabilises foam, causing it to break up and disperse. One side effect of the control of foaming by the manipulation of the solution cloud point is that a solution above its cloud point can appear milky, which will hinder visual observation of the cleaning process.

Another approach to foam control would be to add foam control agents such as silicone oils or silicone/silica defoaming agents. This approach however can lead to the surfaces of the medical instruments becoming contaminated with the defoamer.

One means of preventing foaming would be to use a surfactant free detergent system. Typically this approach has been used in automated dishwashers, using solid detergent systems based on highly alkaline ingredients such as sodium metasilicate, and alkali metal hydroxides. Whilst highly effective as detergents, particularly for fatty or proteinaceous soils, highly alkaline detergents are not suited for the cleaning of many medical instruments, particularly endoscopes, or instruments fabricated from aluminium, or coated with anodised aluminium, due to materials compatibility issues.

Cleaning solutions with a more neutral pH (for example pH 7 to 9) are more instrument-friendly, but are not very effective if formulated without surfactants, as the surfactant assists in the wetting of surfaces, and the solublisation of soils.

Surprisingly it has been found that surfactant free formulations containing alkanolamines, mineral acids, hydroxycarboxylic acid salts and enzymes, at an essentially neutral pH can produce a cleaning solution that produces little or no foam, whilst effectively removing biological soils.

The use of an alkanolamine in a medical instrument detergent has been previously reported. U.S. Pat. No. 6,562,296 for example teaches the use of a non-enzymatic cleaning solution comprising triethanolamine, various chelating agents and a surfactant (N-acyl glutamate), typically added as a wetting agent.

U.S. Pat. No. 4,243,546, EP0481663 and EP0730024 disclose enzyme-containing cleaning solutions which can enzymatically degrade in particular blood proteins. It is proposed there to use triethanolamine for stabilising the enzymes. Each of the formulations also contains, as essential ingredients, surfactants. In the case of U.S. Pat. No. 4,243,546 and EP 0481663, the surfactants are non-ionic, whereas EP 0730024 contains, as an essential component, an anionic surfactant.

The presence of a surfactant within the formulation has the potential to lead to the generation of nuisance foams that can impede the cleaning of medical instruments. There is therefore a constant need for cleaning formulations that produce zero or low foam, even under conditions of high agitation.

SUMMARY OF INVENTION

According to a first embodiment of the invention there is provided a cleaning composition comprising:

a. at least one alkanolamine,
b. at least one mineral acid,
c. at least one salt of a hydroxycarboxylic acid,
d. at least one protease enzyme, wherein said composition contains no surfactant.

According to a second embodiment of the invention there is provided a cleaning solution according to the first embodiment which, on dilution with water, removes biological soils from surgical and medical instruments in automated washers, producing little or foam.

According to a third embodiment of the invention there is provided a method of removing biological soils from surgical and medical instruments comprising washing said instruments in an automated washer using a composition according to the first embodiment, diluted with water.

According to a fourth embodiment of the invention there is provided a process of preparing a cleaning composition comprising combining:

a. at least one alkanolamine,
b. at least one mineral acid,
c. at least one salt of a hydroxycarboxylic acid,
d. at least one protease enzyme;

to form a concentrate, wherein said concentrate contains no surfactant.

According to a fifth embodiment of the invention there is provided a process according to the fourth embodiment comprising diluting said concentrate with water.

Where the terms 'comprise', 'comprised' or 'comprising' are used in this specification (including the claims) they are to be interpreted as specifying the presence of the stated features, integers, steps or components, but not precluding the presence of one or more other features, integers, steps or components, or group thereof.

The invention provides a surfactant free aqueous concentrate comprising a protease enzyme, an alkanolamine, and a suitable acid, wherein said composition, on dilution with water, provides a low or no foaming solution of essentially neutral pH. The solution is well suited for the automated cleaning of surgical and other medical instrumentation.

The cleaning efficacy of the composition is enhanced by the addition of a salt of a hydroxycarboxylic acid. Preferably the salt is a sodium salt and the hydroxycarboxylic acid is gluconic acid.

The invention also provides a method of cleaning a medical or surgical instrument including the step of treating the instrument with a composition including at least one protease enzyme, an alkanolamine and a salt of a hydroxycarboxylic acid, wherein said composition is free of surfactants.

There is a synergistic relationship between the components of the composition of the invention producing a composition with effective cleaning characteristics, and which, on dilution with water, produces little or no foam on agitation. The composition of the invention is therefore highly suited to use in automated cleaning processes.

DETAILED DESCRIPTION OF THE INVENTION

In a preferred embodiment the invention provides for a cleaning composition comprising:

at least one protease enzyme
at least one trialkanolamine
at least one mineral acid
at least one salt of a hydroxycarboxylic acid
wherein said composition contains no surfactant.

The composition of the invention does not contain a surfactant. Throughout the specification and claims, the term "surfactant" is to be taken as meaning an amphiphilic chemical species comprising both a hydrophobic and a hydrophilic group, wherein the hydrophobic group comprises a hydrocarbon group containing 5 or more carbon atoms, and wherein the hydrophilic group may be comprised of an ionic or polyionic functional group, a polyhydroxy group or a polyether group.

Preferably the composition of the invention has a pH in the range of about 7 to about 9.5, more preferably about 7.5 to about 8.5.

Enzyme

The composition of the invention comprises at least one enzyme. In a preferred embodiment, the enzyme is a protease enzyme, and in a particularly preferred embodiment the composition of the invention comprises both a protease enzyme and a secondary enzyme. Preferably, the secondary enzyme is selected from the group consisting of an amylase, a cellulase or a lipase.

Preferably, the total quantity of enzyme (both protease and secondary enzyme) can be between 0.1% and 5% w/w of the composition. More preferably, the composition comprises less than about 1% w/w of the composition total enzyme content to avoid the overall composition being classified as a respiratory sensitiser.

The protease enzyme within the composition may be stabilised in a manner of means. Preferred stabilisation methods include incorporating a small quantity of borate into the composition, including calcium ions in the composition, and restricting the water content of the composition to below about 50% w/w of the composition. A particularly preferred method is to restrict the water content to between about 40% and 50% w/w of the composition.

Preferably the protease enzyme is present in an amount of about 0.5% w/w to about 2.0% w/w of the composition.

A preferred commercial brand of protease enzyme is Properase L1600™, which is a liquid proteinase enzyme solution comprising 1-5% of active subtilisins. A preferred commercial brand of secondary enzyme is Spezyme AA™, a liquid alpha amylase enzyme solution comprising 1-10% active enzymes. Both Properase L1600™ and Spezyme AA™ are supplied by Genencor International.

Alkanolamine

The composition of the invention comprises at least one alkanolamine, which takes the place of a surfactant. The at least one alkanolamine is preferably present in the composition at a concentration of between about 10 and 30% w/w of the composition, more preferably at a concentration of between about 3 and 25% w/w, even more preferably between about 4% to about 22% w/w of the composition.

Preferably, the alkanolamine is selected from the group consisting of monothanolamine, diethanolamine or triethanolamine, most preferably diethanolamine or triethanoline.

Mineral Acid

The at least one mineral acid is preferably used to adjust the pH of the composition of the invention. In a preferred embodiment, the pH of the composition of the invention is adjusted to between about 7.5 and about 8.5.

In a preferred embodiment, the mineral acid may be selected from the group consisting of nitric acid, sulphuric acid, sulphamic acid, phosphoric acid and boric acid, or combinations thereof.

When boric acid is selected, its concentration preferably should not exceed 5% w/w of the composition to avoid the final composition being classified as a reproductive toxin with a R60 and R61 risk phrase (EU Directives 67/548/EEC or 1999/45/EC), or a GHS classification of Reproductive Toxin Category 1B, with a H360 Hazard statement (May damage fertility. May damage the unborn child).

In a particularly preferred embodiment, the composition of the invention comprises phosphoric acid and boric acid, with the phosphoric acid content between about 1 and 10% w/w of the composition. Preferably, the cleaning composition comprises between about 0.5% and about 5% w/w boric acid of the composition.

In a preferred embodiment, the composition of the invention comprises between about 1% and about 9% w/w, more preferably between about 2 and about 7% w/w of the composition phosphoric acid, and about 1% w/w of the composition boric acid.

Salt of a Hydroxycarboxylic Acid

The composition of the invention comprises at least one salt of a hydroxycarboxylic acid. The function of the hydroxycarboxylic acid salt is to sequester calcium and magnesium ions, typically found in hard water. The salt of the hydroxycarboxylic acid may be an alkali metal salt or an alkanolamine salt. More preferably the salt is a sodium salt. Preferably the salt of the hydroxycarboxylic acid is a salt of glycolic acid, lactic acid, gluconic acid, citric acid, tartaric acid or combinations thereof.

A non-exclusive list of salts of hydroxycarboxylic acids that may be utilised in the composition of the invention is sodium citrate, sodium lactate, sodium tartrate, sodium gluconate, sodium glycolate, potassium citrate, potassium lactate, potassium tartrate, potassium gluconate, potassium glycolate, and mixtures thereof.

Preferably, the at least one hydroxycarboxylic acid salt may provide additional properties other than simple complexation, such as the solubilisation of fats and other soil components, and also act as a corrosion inhibitor for ferrous metals such as stainless steel.

In a preferred embodiment, the hydroxycarboxylic acid salt is sodium gluconate.

Also contemplated are embodiments in which a non-metal salt is utilised. In these embodiments, the hydroxycarboxylic acid is neutralised with the alkanolamine.

The hydroxycarboxylic acid salt is preferably present in an amount between about 1.0% to 26% w/w, more preferably between about 1 to about 18% w/w of the composition (expressed as the weight of the parent acid)

The roles of the various ingredients can be illustrated in the following examples.

In these examples, various combinations of the preferred ingredients were prepared, and diluted to a working concentration of 1 ml/liter. The diluted solutions were then assessed for cleaning efficacy, as well as static and dynamic foam volumes.

Glycol Solvent

The composition of the invention may also contain a solvent comprising a glycol or glycol ether. The role of the solvent is to couple the ingredients together to give a homogenous solution, and also to reduce the water content of the overall composition to between about 40 and 50% to stabilise the protease enzyme. Examples of suitable glycol solvents which may be used in the composition of the invention are ethylene glycol, propylene glycol, butyl glycol, triethylene glycol, propylene glycol monomethyl ether, dipropylene glycol monomethyl ether, diethylene glycol monomethyl ether, glycerol and combinations thereof.

In a preferred embodiment, the glycol solvent will be present in the formulation in an amount between about 5% and about 40% w/w of the composition of the invention. In a more preferred embodiment the glycol solvent will be present in an amount between about 15% and about 25% w/w of the composition of the invention.

Cleaning Efficacy

Cleaning efficacies were assessed using a domestic dishwasher (Samsung model DW5343TGBWQ), using the "Quick 50" program. In this cycle, 3.44 liters of water is used in the wash cycle, so 3.4 ml of detergent is placed into the detergent dispenser. The wash cycle on the "Quick 50" program is 34 minutes long. The detergent is released from the dispenser after 2 minutes, when the water temperature is 28° C. At 6 minutes, the water has reached its maximum temperature of 50° C. Washing is continued for a further 10 minutes, after which time the chamber is drained. After 2 rinse cycles with cold water, the wash program is complete.

Two types of commercial wash checks (TOSI and Brownes STF) were then placed into the chamber of the washer, along with various items of artificially soiled surgical instrumentation, and the wash cycle started.

Commercial Wash Checks

The following commercial wash checks were used to evaluate cleaning efficacy:

1. ProFormance TOSI

This is a simulated blood clot on a scratched stainless steel slide swatch mounted in a plastic holder to mimic dried blood on a surgical instrument. The test soil is comprised of both fibrin and haemoglobin. The TOSI test soil has been described in U.S. Pat. No. 6,107,097.

In use, the wash check is clipped onto a rack within the chamber of the washer. A successful wash will remove all of the test soil from the stainless steel.

2. Brownes STF

The Brownes STF is an artificial soil printed onto both sides of a plastic film. The soil comprises two sources of protein, lipids and polysaccharides. In use, the wash check is mounted into a stainless steel holder comprised of a grid, and then placed into the chamber of the washer.

Testing of Various Formulation Components

Formulations according to examples 1-6 were prepared and tested for cleaning efficacy as described above.

TABLE 1

| | Example | | | | | |
|---|---|---|---|---|---|---|
| | 1 % w/w | 2 % w/w | 3 % w/w | 4 % w/w | 5 % w/w | 6 % w/w |
| 48.5% Sodium hydroxide solution | — | — | 1 | 1 | 1 | 1 |
| Boric Acid | — | — | 1 | 1 | 1 | 1 |
| Sodium Gluconate | — | 5 | — | 5 | — | 5 |
| 85% Triethanolamine solution | 20 | 20 | — | — | 20 | 20 |
| 85% Phosphoric Acid solution | 7 | 7 | — | — | 7 | 7 |
| Propylene Glycol | — | — | 20 | 20 | 20 | 20 |
| Properase L1600 | — | — | 10 | 10 | 10 | 10 |
| Spezyme AA | — | — | 4 | 4 | 4 | 4 |
| DI water | to 100% | to 100% | to 100% | to 100% | to 100% | to 100% |

All formulae adjusted to pH 7.60-7.70 using phosphoric acid or sodium hydroxide solution Each of the formulations given in Table 1 was tested in the Samsung dishwasher against both Brownes and TOSI.

The relative cleaning efficacies were assessed by 3 independent observers on a 5 point scale where 1=no observed soil removal through to 5=total soil removal. The results are shown in Table 2 (Brownes STF) and Table 3 (TOSI).

TABLE 2

| | Brownes STF | | | | | |
|---|---|---|---|---|---|---|
| | Example 1 | Example 2 | Example 3 | Example 4 | Example 5 | Example 6 |
| Operator 1 | 1 | 1 | 3 | 4.00 | 3.16 | 3.41 |
| Operator 2 | 1 | 1 | 3 | 4 | 4 | 4 |
| Operator 3 | 1 | 1 | 3 | 3.5 | 3.5 | 4 |
| Mean score | 1.0 | 1.0 | 3.0 | 3.9 | 3.6 | 3.8 |

TABLE 3

| | TOSI | | | | | |
|---|---|---|---|---|---|---|
| | Example 1 | Example 2 | Example 3 | Example 4 | Example 5 | Example 6 |
| Operator 1 | 1.5 | 1.5 | 2.25 | 2.5 | 4.5 | 4.5 |
| Operator 2 | 1 | 1.5 | 2.5 | 4 | 5 | 5 |

TABLE 3-continued

| | TOSI | | | | | |
|---|---|---|---|---|---|---|
| | Example 1 | Example 2 | Example 3 | Example 4 | Example 5 | Example 6 |
| Operator 3 | 2 | 2 | 3 | 3.5 | 4.5 | 5 |
| Mean score | 1.5 | 1.7 | 2.6 | 3.3 | 4.7 | 4.8 |

As can be seen in Tables 2 and 3, the combination of both triethanolamine/phosphate with enzymes increases the efficacy of the formulation compared to the individual component sets. Even more surprising is the inclusion of sodium gluconate gives a further improvement in efficacy when combined with triethanolamine/phosphate and enzymes, particularly against TOSI.

The complete formulation (example 6) was then tested against gross soil loading. The UK Test soil and method for surgical instruments, surgical instrument trays, bowls, dishes and receivers, described in Annex N of ISO 15883-5 was used to assess cleaning efficacy against heavily soiled instruments.

The soil, also known as Edinburgh soil, was prepared as follows:

100 ml of fresh egg yolk was placed in a mixing bowl, along with 10 ml of defribrinated horse blood (Serum Australis), and 2.0 g of porcine mucin (Sigma Aldrich). The ingredients were then mixed using an orbital blender until a homogeneous blend was achieved.

The test soil was then applied to various representative surgical instruments, such as clamps, forceps, scissors, speculums and retractors using a paint brush, ensuring that the more complex and occluded parts of the instruments, such as box hinges etc were liberally coated in soil. The instruments were then allowed to dry for at least 1 hour before loading into the washer. After cleaning, the instruments were then inspected visually for the presence of soil, and then swabbed, and the swab tested with Ninhydrin solution to determine the presence/absence of protein.

After cleaning using the Samsung washer, using the "Quick 50" program, the instruments were visibly clean. Swabbing the surface of the instruments, particularly around the hinge joints etc with a cotton wool swab, and then applying a drop of a 2% Ninhydrin solution in ethanol, followed by warming the swab to 60° C. in an oven demonstrated the absence of any protein residues.

Foaming Characteristics

Three additional formulations were prepared. Two comparative formulations (examples 7 and 8) were prepared using low foaming surfactants, whereas examples 9 and 10 were prepared without surfactants, but with triethanolamine, phosphoric acid, sodium gluconate and a blend of protease and amylase enzymes according to the present invention.

TABLE 4

| | Comparative Example 7 % w/w | Comparative Example 8 % w/w | Example 9 % w/w | Example 10 % w/w | Example 11 % w/w |
|---|---|---|---|---|---|
| DI water | 42.99 | 55.48 | 37.63 | 41.44 | 42.16 |
| 48.5% NaOH | 0.80 | 0.80 | 0.85 | 0.79 | |
| Boric acid | 0.94 | 0.94 | 0.85 | 4.46 | 4.54 |
| sodium gluconate | 2.83 | 2.83 | 4.28 | 1.79 | 1.82 |
| 85% Triethanolamine | — | — | 20.13 | 18.76 | 18.18 |
| 85% Phosphoric acid | — | — | 7.04 | 2.24 | 2.27 |
| propylene glycol | 18.86 | 18.89 | 17.10 | 17.87 | 18.18 |
| Pluronic PE6400 | 11.79 | 0.00 | — | — | — |
| Pluronic PE6200 | 0.00 | 4.25 | — | | — |
| Lutensol XL40 | 9.43 | 1.13 | — | — | — |
| Triton H66 | — | 3.31 | — | — | — |
| Properase L 1600 | 8.49 | 8.50 | 8.56 | 8.94 | 9.09 |
| Spezyme AA | 3.77 | 3.78 | 3.42 | 3.57 | 3.64 |
| Proxel GXL | 0.09 | 0.09 | 0.12 | 0.14 | 0.13 |

Each formulation was diluted with tap water to give a 1 ml/liter solution, and the foam volumes assessed at both room temperature and 55° C. The foam volumes were assessed by placing 50 ml of the diluted solution in a 100 ml measuring cylinder fitted with a stopper. The solution was brought to the requisite temperature using a water bath. The cylinder was then vigorously shaken 20 times, and the foam volume measured immediately, and after 30 seconds.

As can be seen in Table 5, whilst the solutions prepared from examples 7 and 8 were relatively low foaming, the solution prepared from example 9 gave zero foam, even at room temperature.

The solutions from examples 7 and 8 were also observed to be slightly hazy at room temperature, and milky in appearance at 55° C., due to the fact that the solutions were above the cloud point of the non-ionic surfactant mix. The solution from example 9 remained clear and free of any haze or milkiness even on heating to 55° C.

TABLE 5

| | Foam volumes | | | |
|---|---|---|---|---|
| | 25° C. | | 55° C. | |
| | Initial | 30 seconds | Initial | 30 seconds |
| Example 7 | 18.5 ml | 4.5 ml | 14 ml | 2.5 ml |
| Example 8 | 14 ml | 3 ml | 12 ml | 2 ml |
| Example 9 | 0 ml | 0 ml | 0 ml | 0 ml |
| Example 10 | 0 ml | 0 ml | 0 ml | 0 ml |
| Example 11 | 0 ml | 0 ml | 0 ml | 0 ml |

The examples clearly show the synergistic relationship between the components of the composition of the invention, producing a cleaning composition which, on dilution with water, produces little or no foam on agitation.

Example 12

The following example demonstrates a formulation with lower concentrations of ingredient.

| | % w/w |
|---|---|
| DI water | 44.93 |
| Boric acid | 1.00 |
| Sodium gluconate | 1.00 |
| Dowanol DPM | 44.89 |
| 50% sodium hydroxide | 0.64 |
| 85% triethanolamine | 3.99 |
| 85% phosphoric acid | 1.40 |
| Properase L 1600 | 2.00 |
| Mergal K20 | 0.15 |

This formulation is intended to be used at a dilution of 5 ml/Liter

Washer-Disinfector Trials

The formulation of example 9 was trialled in a range of different washer disinfectors. Typical cycles used in the trials included a cold water pre-wash, followed by the main wash cycle.

Following the wash cycle, two rinse cycles were performed, with the last rinse cycle being performed at a temperature of 90° C. degrees to disinfect the load. During the wash cycle, the load chamber was visually monitored for foaming. The cycles were also run with multiple wash checks (both TOSI and Brownes STF) on each shelf within the washer disinfector. In order to record a pass, every wash-check within the chamber had to be clear of any visual residue.

TABLE 6

| Washer disinfector | Detergent concn. | Wash temp. | Wash time | Foaming | TOSI | Brownes STF |
|---|---|---|---|---|---|---|
| Getinge Turbo 88 | 2 ml/L | 60° C. | 5 min | None | PASS | PASS |
| Steris Reliance Synergy | 3 ml/L | 65° C. | 5 min | None | PASS | PASS |
| Steris Reliance Vision | 4 ml/L | 60° C. | 5 min | None | PASS | PASS |
| Getinge 86 Series | 5 ml/L | 60° C. | 5 min | None | PASS | PASS |
| Medisafe Niagra SI PCF | 6 ml/L | 60° C. | 5 min | None | PASS | PASS |
| Steelco DS 800 | 5 ml/L | 60° C. | 5 min | None | PASS | PASS |
| Atherton Innova M5 | 1.7 ml/L | 60° C. | 5 min | None | PASS | PASS |
| Lancer | 2 ml/L | 60° C. | 8 min | None | PASS | PASS |

Example 13: Preparation of Potassium Salt Version

In this example, a formulation similar to that of Example 9 was prepared, but using potassium salts rather than sodium salts. Given that potassium gluconate is not readily available commercially, gluconolactone was used. During the manufacture of the embodiment, the gluconolactone reacts with potassium hydroxide to generate the potassium salt of gluconic acid.

TABLE 7

| Ingredient | % w/w | |
|---|---|---|
| DI water | 38.49 | |
| 48% Potassium hydroxide solution | 3.58 | |
| Gluconolactone | 3.57 | Source of gluconic acid |
| Boric acid | 0.87 | Inorganic acid |
| Propylene Glycol | 17.49 | |
| 85% Triethanolamine | 17.49 | |
| 85% phosphoric acid | 6.12 | |
| Properase L1600 | 8.75 | Protease enzyme |
| Spezyme AA | 3.50 | Amylase enzyme |
| Mergal K20 | 0.13 | preservative |

The final formulation was found to have a specific gravity of 1.1345 and a refractive index of 1.4061. The pH of the formulation was 7.81.

The benefits of the potassium salt formulation of example 10 compared to the sodium equivalent of example 9 lie in the much greater water solubility of the potassium salts. This renders the formulation significantly more cold stable, allowing the product to be stored below 0° C. for prolonged periods without any component crystallising out of the formulation.

Alternate Embodiments

In the following examples, alternative embodiments utilising monoethanolamine as the alkanolamine, and a range of differing hydroxyacetic acids were prepared. In these examples, boric and phosphoric acids were used as the mineral acid, and the hydroxyacetic acids were neutralised by the alkanolamine.

TABLE 8

| | Example 14 % w/w | Example 15 % w/w | Example 16 % w/w |
|---|---|---|---|
| DI water | 36.23 | 38.47 | 48.89 |
| Monoethanolamine | 11.32 | 11.39 | 7.75 |
| Boric acid | 1.81 | 1.82 | 1.87 |
| Propylene glycol | 18.11 | 18.22 | 18.70 |
| 85% Phosphoric acid | 2.13 | 2.14 | 2.20 |
| Effectenz P150 | 9.06 | 9.11 | 9.35 |
| Spezyme AA | 3.62 | 3.64 | 3.74 |
| 80% Lactic acid | 17.72 | — | — |
| Glycolic acid | — | 15.21 | — |
| Citric acid | — | — | 7.49 |
| Formulation pH | 7.77 | 7.82 | 7.88 |

When tested against Brownes STF and TOSI, examples 11 to 13 were shown to have similar activity to example 9 when assessed at 1 ml/liter concentration and 50° C. in a Samsung dishwasher as described above.

In the following examples, the alkanolamine is diethanolamine. Given diethanolamine also serves as a corrosion inhibitor, these examples can help protect metal instrumentation against corrosion.

TABLE 9

| | Example 17 % w/w | Example 18 % w/w |
|---|---|---|
| DI water | 34.36 | 43.31 |
| Diethanolamine | 18.48 | 13.33 |
| Boric acid | 1.72 | 1.87 |
| Propylene glycol | 9.45 | 18.70 |
| 85% Phosphoric acid | 2.02 | 2.20 |
| Effectenz P150 | 8.59 | 9.35 |
| Spezyme AA | 8.59 | 3.74 |

TABLE 9-continued

| | Example 17 % w/w | Example 18 % w/w |
|---|---|---|
| 80% Lactic acid | 16.80 | — |
| Citric acid | — | 7.49 |
| Formulation pH | 7.60 | 7.75 |

The invention claimed is:

1. A cleaning composition comprising:

a. At least one alkanolamine;

b. At least one mineral acid;

c. At least one salt of a hydroxy monocarboxylic acid;

d. At least one protease enzyme; and wherein said composition contains no surfactant.

2. A cleaning composition according to claim 1 wherein the composition has a pH in the range of about 7 to about 9.5.

3. A cleaning composition according to claim 2, wherein the pH is in the range of about 7.5 and about 8.5.

4. A cleaning composition according to claim 1 and also comprising a secondary enzyme.

5. A cleaning composition according to claim 4 wherein the secondary enzyme is selected from the group consisting of an amylase, a cellulase or a lipase.

6. A cleaning composition according to claim 1 wherein the total enzyme content of said composition is between about 0.1% and 5% w/w.

7. A cleaning composition according to claim 1 wherein the protease enzyme is present in an amount of about 0.5% to about 2.0% w/w of the composition.

8. A cleaning composition according to claim 1 wherein the alkanolamine is present at a concentration of between about 3 and 25% w/w of the composition.

9. A cleaning composition according to claim 8 wherein the alkanolamine is present at a concentration of about 4% to about 22% w/w of the composition.

10. A cleaning composition according to claim 1 wherein the alkanolamine is selected from the group consisting of monoethanolamine, diethanolamine and triethanolamine.

11. A cleaning composition according to claim 1 wherein the mineral acid is selected from the group consisting of nitric acid, sulphuric acid, sulphamic acid, phosphoric acid and boric acid, and combinations thereof.

12. A cleaning composition according to claim 11 comprising phosphoric acid and boric acid.

13. A cleaning composition according to claim 12 wherein the phosphoric acid is present in an amount of about 1 and 10% w/w of the composition.

14. A cleaning composition according to claim 12 comprising between about 0.5% to 5% w/w boric acid.

15. A cleaning composition according to claim 13 comprising between about 1 and about 9% w/w phosphoric acid and about 1% w/w boric acid.

16. A cleaning composition according to claim 15 comprising between about 2% and about 7% w/w phosphoric acid and about 1% w/w boric acid.

17. A cleaning composition according to claim 1 wherein the salt of the hydroxy monocarboxylic acid is a salt of any one or more of glycolic acid, lactic acid, gluconic acid or combinations thereof.

18. A cleaning composition according to claim 1 wherein the salt of the hydroxy monocarboxylic acid is an alkali metal salt.

19. A cleaning composition according to claim 18 wherein the salt of hydroxy monocarboxylic acid is a sodium salt.

20. A cleaning composition according to claim 17 wherein the salt of hydroxy monocarboxylic acid is selected from the group consisting of sodium lactate, sodium gluconate, sodium glycolate, or mixtures thereof.

21. A cleaning composition according to claim 20 wherein the salt of hydroxy monocarboxylic acid is sodium gluconate.

22. A cleaning composition according to claim 1 wherein the salt of the hydroxy monocarboxylic acid is an alkanolamine salt.

23. A cleaning composition according to claim 1 wherein the salt of the hydroxy monocarboxylic acid is present in an amount between about 1% and 26% w/w of the composition.

24. A cleaning composition according to claim 23 wherein the salt of hydroxy monocarboxylic acid is present in an amount of about 1 to about 18% w/w of the composition.

25. A cleaning composition according to claim 1 wherein the composition also comprises a glycol solvent.

26. A cleaning composition according to claim 25 wherein said glycol solvent is selected from the group consisting of ethylene glycol, propylene glycol, butyl glycol, triethylene glycol, propylene glycol monomethyl ether, dipropylene glycol monomethyl ether, diethylene glycol monomethyl ether, glycerol and combinations thereof.

27. A cleaning composition according to claim 26 wherein said glycol solvent is present in an amount between about 5% and 40% w/w of the composition.

28. A method of cleaning and removing biological soil from surgical and medical instruments in an automated washer using a water diluted cleaning composition according to claim 1.

29. A process of preparing a cleaning composition for medical and surgical instruments to be cleaned in an automated washer, comprising combining:

a. at least one alkanolamine b. at least one mineral acid c. at least one salt of a hydroxy monocarboxylic acid; and d. at least one protease enzyme;

to form a concentrate, wherein said concentrate contains no surfactant.

30. A process according to claim 29 comprising diluting said concentrate with water.

* * * * *